US005487762A

United States Patent [19]

Sinha

[11] Patent Number: 5,487,762

[45] Date of Patent: Jan. 30, 1996

[54] METHOD OF MINIMIZING DEPOSITS WHEN FIRING TIRE DERIVED FUELS

[75] Inventor: Rabindra K. Sinha, Coraopolis, Pa.

[73] Assignee: Calgon Corporation, Pittsburgh, Pa.

[21] Appl. No.: 382,347

[22] Filed: Feb. 1, 1995

[51] Int. Cl.[6] ..... C10L 1/24

[52] U.S. Cl. ..... 44/363; 44/367; 44/370; 44/605; 44/628; 44/457; 110/342; 110/346

[58] Field of Search ..... 44/457, 603, 605, 44/628, 363, 367, 370; 110/342, 346

[56] References Cited

U.S. PATENT DOCUMENTS

| | | | |
|---|---|---|---|
| 2,845,338 | 7/1958 | Ryznar et al. . | |
| 3,506,414 | 4/1970 | Skendrovic | 110/8 |
| 3,864,094 | 2/1975 | Locketz | 44/605 |
| 3,946,680 | 3/1976 | Laman | 110/18 C |
| 4,180,004 | 12/1979 | Johnson | 44/605 |
| 4,202,671 | 5/1980 | Diehl et al. . | |
| 4,503,019 | 3/1985 | Sinha | 423/175 |
| 4,512,774 | 4/1985 | Myers et al. . | |
| 4,804,388 | 2/1989 | Kukin | 44/603 |
| 4,822,379 | 4/1989 | Thompson | 44/605 |
| 5,115,983 | 5/1992 | Rutherford | 241/1 |

*Primary Examiner*—Margaret Medley
*Attorney, Agent, or Firm*—Diane R. Meyers; Craig G. Cochenour; William C. Mitchell

[57] ABSTRACT

Methods for minimizing deposits in boilers, furnaces, incinerators or other systems firing tire derived fuels when burned in combination with other fuels which may include fuel oils are disclosed. These methods include treating the fuels so as to raise the magnesium content of the fuels or their combustion products comprising adding to the fuels one or more magnesium-containing compounds. The methods of treating tire derived fuels when they are burned with other fuels not including fuel oils includes adding to the fuel a suspension of magnesium hydroxide in water. The method of treating tire derived fuels when they are burned in combination with other fuels including fuel oils involves adding to the fuel a compound containing a magnesium-based slag mitigation component and a heavy metal combustion catalyst. In a preferred method of treating tire derived fuels when burned in combination with fuel oil, both the suspension of magnesium hydroxide in water and the solution containing the slag mitigation component and combustion catalyst are used to treat the fuels.

11 Claims, No Drawings

METHOD OF MINIMIZING DEPOSITS WHEN FIRING TIRE DERIVED FUELS

BACKGROUND OF THE INVENTION

1. Field of the Invention

This invention relates to a method for minimizing deposits when firing tire derived fuels, such as, for example, tire chips, in combination with other fuels. More specifically, the invention relates to a method for minimizing deposits by increasing the level of magnesium in the fuel(s) being burned.

A variety of fuels are used in firing systems such as, for example, large industrial and institutional boilers, furnaces, incinerators, etc. Examples of these fuels include, but are not limited to, residual fuel oils such as No. 6 fuel oil, coal, wood chips, bark, municipal mill sludge, hog fuel, pelletized sawdust, and tire derived fuels such as tire chips. Typically, more than one of these fuels is burned at the same time. Deposits resulting from combustion of these various types of fuel, referred to as fireside deposits, for example ash and slag, are the result of inorganic contaminants or other impurities in the fuel. In the high temperature zone of a typical boiler system, for example the waterwalls, screen tubes, superheaters and convection risers, where temperatures typically reach greater than 1200° F., such fireside deposits ultimately result in an unacceptable lowering of heat transfer efficiency and reduction of boiler service life. In addition, these deposits are an expensive problem in boilers and other systems causing delays and shutdowns for cleaning and removal.

Tire derived fuels are attractive economically, but the concentration of zinc in the fuels is higher than that of almost all other fuels. Zinc not only forms a part of the ash and slag of the fireside deposits, but the reaction of zinc with potassium and sulfur oxides to produce potassium zinc sulfate, among other things, significantly contributes to both the amount of deposit and the rate of build-up. Accordingly, systems burning tire derived fuels will be forced to shutdown more frequently for removal of these excessive deposits than will those systems operating without tire derived fuels.

2. Brief Description of Background Art

U.S. Pat. No. 2,845,338 discloses the use of blends of magnesium oxide and copperoxychloride to inhibit deposit in coal-fired boiler furnaces.

U.S. Pat. No. 4,503,019 discloses the use of blends of magnesium oxide and copperoxychloride to inhibit calcium oxide deposit in coal-fired lime kilns.

U.S. Pat. No. 4,202,671, which is hereby incorporated by reference, discloses an organic magnesium and organic manganese compound for use in reducing fuel oil requirements and sulfur trioxide emissions produced during combustion, but does not disclose use of this compound when firing tire derived fuels.

U.S. Pat. No. 4,512,774 discloses the use of residual fuel oil conditioners in improving combustion deposits and corrosion resulting from the burning of residual fuel oils.

There is no suggestion that the methods and/or compounds disclosed in any of the above references minimize deposits in boilers and furnaces firing a combination fuel including tire derived fuels. Further, use of conventional treatments such as those disclosed in the background art do not produce acceptable results when tire derived fuels are burned. Accordingly, there is a need for a method of minimizing deposits in systems burning tire derived fuels.

SUMMARY OF THE INVENTION

The present invention has met the above described need. In accordance with the present invention there is provided a method of treating tire derived fuels so as to minimize the deposits which result from the high levels of zinc in these fuels as compared to other fuels. This method involves increasing the magnesium levels in either the tire derived fuels themselves, or in their combustion products while these products are in the boiler, furnace, etc. When tire derived fuels are burned with other fuels not including fuel oil, the combination fuel is treated with a fuel conditioner containing a suspension of magnesium hydroxide in water. When tire derived fuels are burned in conjunction with other fuels including fuel oil, such as, for example, No. 6 fuel oil, the fuels are treated with a fuel conditioner containing a slag-mitigating component, such as, for example, a magnesium containing compound, and a combustion catalyst, such as, for example, a heavy metal. These fuel conditioning treatments increase the magnesium content of the fuel ash, thereby making the ash less adherent than it would be without the treatments and readily removable by the normal practice of blowing soot.

DESCRIPTION OF THE INVENTION

The present invention is directed to a method for treating tire derived fuels, such as tire chips, whereby the deposits associated with the combustion of these fuels is minimized. Combustion of tire derived fuels results in fireside deposits much more excessive than those deposits which result from burning nearly any other type of fuel. This excessive deposit formation is related to the high zinc content of the tire derived fuels. Typically, tire derived fuels are burned in combination with one or more other fuels such as No. 2 and No. 6 fuel oils, mill sludge, hog fuel, saw dust pellets, wood chips, bark and others. The present invention discloses a method of treating tire derived fuels, such as for example when the tire derived fuels are burned with other fuels including fuel oil, and when they are burned with other fuels not including fuel oil.

The addition of one or more magnesium-based fuel conditioners to the fuels being burned results in increased magnesium levels. The deposits associated with tire fuel combustion are minimized when the level of magnesium in these fuels is increased. Increasing the magnesium level of the tire derived fuels results in the fly ash becoming less adherent and therefore more easily removed by conventional soot-blowing techniques. If burning tire derived fuels with other fuels not including fuel oil, a magnesium hydroxide suspension is used to treat the fuels. If burning tire derived fuels with other fuels including fuel oil, the fuel conditioner(s) used in the methods of the present invention employs two components—a slag mitigation component and a combustion catalyst. Although any slag mitigation compound can be used, the slag mitigation component is preferably a magnesium containing compound typically in the form of magnesium sulfonate, magnesium carbonate, and the like. The combustion catalyst likewise can be any combustion catalyst known in the art, but is preferably an organic salt of a heavy metal, such as, for example, an organic manganese salt or an organic barium salt. The particular fuel conditioner(s) used can be selected by the system operator depending on numerous factors including, for example, the types of fuel being burned and the emissions requirements under which the particular system operates.

If tire derived fuels are being burned in combination with fuels other than fuel oil, the methods of the present invention are most preferably carried out by treating the combination fuel by adding to the system an effective amount of a conditioner comprising a suspension of (a) from about 45 to 50% by weight magnesium hydroxide ($Mg(OH)_2$), (b) from about 1 to 5% by weight dispersant and (c) from about 45 to 54% water. This formulation will be referred to below as "Product A". Any organic dispersant capable of preventing solids from precipitating can be used, particularly those dispersants containing amino, sulfonyl or carboxylic groups. An appropriate dispersant would be, for example, Witconate P-10-59 available from Witco, Co.

A suspension having the parameters defined above is commercially available from Calgon Corporation, Pittsburgh, Pa. For systems producing between 200,000 and 600,000 pounds of steam per hour, Product A is effective in dosages ranging from approximately 30 to 100 gallons per day, with a dosage of about 60 gallons per day being preferred. It is anticipated that this effective dosage range will vary depending on the output of the system and the amount of tire derived fuel being burned. It is well within the ability of one having ordinary skill in the art to determine the effective and preferred amount of fuel conditioner for each system.

If tire derived fuels are burned in addition to other fuels including fuel oil, the methods of the present invention are prefereably carried out by treating the combination fuel by adding to the system an effective amount of a conditioner comprising a solution of (a) an organic magnesium-manganese compound, (b) a dispersant, and (c) No. 2 fuel oil, in such proportions so that the active magnesium metal concentration of the solution is from about 4.5 to 5.5% by weight, and the active manganese metal concentration is from about 1 to 1.5% by weight. This formulation will be referred to below as "Product B". Any organic dispersant capable of preventing solids from precipitating can be used, particularly those dispersants containing amino, sulfonyl or carboxylic groups. The organic magnesium-manganese compound can be derived from salts containing magnesium and manganese, such as carboxylates, sulfonates and the like.

A solution having the parameters defined above is commercially available from Calgon Corporation, Pittsburgh, Pa. Here, the slag mitigation component is the magnesium and the combustion Catalyst is manganese. For systems producing from about 200,000 to 600,000 pounds of steam per hour, Product B is effective in dosages ranging from about 1 gallon of Product B for about every 500 gallons of fuel oil being burned to about 1 gallon of Product B for about every 5000 gallons of fuel oil being burned, with a dosage of about 1 gallon of Product B for about every 2000 gallons of fuel oil being preferred. As with the Product A, the effective and preferred amount of Product B will vary depending upon various system parameters, and it is within the ability of one having ordinary skill in the art to determine the optimum amount of fuel conditioner for each system.

Another fuel conditioner for use in the methods of the present invention when burning both tire derived fuels and fuel oil, similar to Product B, is a solution of (a) an organic magnesium-manganese compound, (b) a dispersant, and (c) water in such proportions that the active magnesium metal concentration is between about 4.5 and 5.5% by weight and the active manganese metal concentration is between about 1 and 1.5% by weight. This formulation will be referred to below as "Product C". An appropriate dispersant would be, for example, Tween® 20, available from ICI. A product having these parameters is commercially available from Calgon Corporation, Pittsburgh, Pa. Product B and Product C differ only in that Product B is an organic solution and Product C contains magnesium and manganese salts which are water soluble. The effective dosage for Product C is the same as that for Product B. Product B and Product C could be used interchangeably, with Product C providing the more economical choice.

Yet another preferred method for treating fuels according to the present invention when burning tire derived fuels and fuel oil is carried out by treating the combination fuel by adding to the system an effective amount of a solution of (a) an organo-magnesium compound overbased with magnesium carbonate in No. 2 fuel oil, and (b) an organo-barium compound, wherein the active magnesium metal concentration is from about 4.5 to 5.5% by weight, and the active barium metal concentration is from about 0.3 to 0.5% by weight. Both the organo magnesium and organo barium compounds can be derived from salts containing magnesium and barium respectively, such as carboxylates, sulfonates, and the like. This formulation will be referred to below as "Product D". A solution having these parameters is commercially available from Calgon Corporation, Pittsburgh, Pa. The effective dosage of Product D is the same as that for Product B or Product C.

In the most preferred embodiment of carrying out the methods of the present invention, a combination of Product A and either Product B, Product C or Product D is used to treat a combination fuel including, but not limited to, tire derived fuels and fuel oil. Either of these fuel conditioner combinations will provide not only the most effective results, but also more economical results than when using only one of the Products. Effective dosage ranges for each of Products A through D when used in combination with another of Products A through D are the same as listed above for systems producing from about 200,000 to 600,000 pounds of steam per hour—that is, from about 30 to 100 gallons per day of Product A and 1 gallon of Products B, C or D for about 500 to 5000 gallons of fuel oil. A 60 gallon per day dosage of Product A is preferred; the amount of Products B, C or D will be at the lower end of the effective dosage range, such as for example, 1 gallon of Product for about.500 gallons of fuel oil, when also using Product A than if using the Product B, C or D alone. The Products should be added in amounts sufficient to raise the magnesium oxide (MgO) content in the ash and/or slag deposit from about 1 to 10% by weight. Again, the amount of each of the Products to use will differ depending on the system parameters such as the amount of steam output and the exact type and proportion of fuels being burned.

Both Product B, Product C and Product D function similarly in the boiler environment, so the choice of which product to use in combination with the Product A is based on the needs and desires of the individual user. For example, a user concerned with manganese emissions would select the non-manganese containing compound, Product D for use in combination with Product A.

It will be understood by those skilled in the art that other compounds containing a magnesium slag mitigation component and a combustion catalyst will be equally effective in minimizing the deposits resulting from combustion of tire derived fuel in combination with fuel oil.

According to the methods of the present invention, the fuel conditioner(s) may be introduced into the boiler, furnace, etc., at several points in the feeding system typical of those employed with large industrial and institutional systems. To achieve the desired results, the conditioner is preferably applied directly to the furnace as a fine mist. This application can be accomplished by atomizing the conditioner through a nozzle with any suitable compressed gas; such a procedure is well within the ordinary skill of one practicing in the art. Diluting the conditioner with water facilitates its atomizing. The fuel conditioner can also be introduced to the system indirectly, such as through incorporation into a liquid fuel. For example, when a liquid residual fuel oil, such as No. 6 fuel oil, is being fired in addition to the tire derived fuel, the fuel conditioner is conveniently added into the residual oil feed line just before it reaches the burner unit. Alternatively, any other means known in the art can be employed. Introduction of the conditioner may be either continuous or intermittent, as will be appreciated by those skilled in the art.

Treatment of the fuels with one or more of the magnesium-containing fuel conditioners as described above changes the characteristics of the ash, slag or other deposits in two ways. First, it weakens the strength of the deposit, thereby making the deposit easier to remove by conventional soot-blowers. Second, it increases the ash fusion temperatures which decreases the adhering tendencies of the deposits. The changing of both of these characteristics contributes to the minimization or reduction of deposits on the components of the fuel burning system.

An advantage of the methods of the present invention is that they allow for the utilization of tire wastes as fuel together with other waste fuels, such as, for example, mill sludge and bark. Since the treatment changes the chemistry of the deposit, it works whenever tires are burned with any sulfur and potassium containing fuel such as coal, oil, waste oils, or black liquor. In short, the present invention provides an effective approach to minimizing deposits in boilers burning waste fuels.

The following examples will illustrate the advantages of the present invention, and are not intended to limit the scope of the methods of the present invention in any way.

EXAMPLE I

Determining Crushing Strength Of Deposits Subjected To Various Treatments

The strength of deposits subjected to various fuel conditioning treatments, as described below, was tested by conducting a sinter strength test. Deposit samples were collected from various high temperature areas of a boiler firing dewatered mill sludge, bark, saw dust pellets, tire derived fuel and No. 6 fuel oil. The samples were ground to pan through 100 mesh U.S. sieve screen. The powdered samples where then treated with one of four treatments. Treatment #1 was calcined alumina, a conventional one component acid component, Treatment #2 was a conventional three component powder mixture containing alumina, titania and silica, Treatment #3 was with Product A as obtained from Calgon Corporation and Treatment #4 was with Product B as obtained from Calgon Corporation. The amount of fuel conditioner contained in the sample was either 2% 5% 10% 20% or 0% (blank) by weight as indicated in Tables 1–3.

Four gram allotments of the powdered samples containing the treated deposit were weighed and transferred to porcelain crucibles. The crucibles were covered and heated in a furnace for 16 hours at a temperature of either 1200° C. or 1400° C. as indicated in Tables 1–3. Upon heating, the powdered, treated sample formed a pellet or button.

The crushing strength, or sinter strength, of the buttons was then determined. This was done by placing the buttons, one at a time, on a monopan balance. A knife edge was used to put pressure on the buttons until the button broke, or became powdered. The pressure employed when the button broke, which represents the sinter strength of the button, was then recorded. Tables 1, 2 and 3 reflect the sinter strengths for the samples subjected to the different treatments.

TABLE 1

| | Crushing Strength, PSI | | | |
|---|---|---|---|---|
| Treatment | Blank | 2% | 5% | 10% |
| #1 | 8076+ | 8076+ | 8076+ | 8076+ |
| #2 | 8076+ | 8076+ | 8076+ | 8076+ |
| #3 | 8076+ | 8076+ | 1322 | 484/514* |
| #4 | 8076+ | 8076+ | 2203 | 514 |

*Duplicate sample
Heat Temperature 1200° F.

TABLE 2

| | Crushing Strength, PSI | | | |
|---|---|---|---|---|
| Treatment | Blank | 2% | 5% | 10% |
| #1 | 8076+ | 8076+ | 8076+ | 8076+ |
| #2 | 8076+ | 8076+ | 8076+ | 8076+ |
| #3 | 8076+ | 8076+ | 1762 | 411/1140* |
| #4 | 8076+ | 8076+ | 5874 | 624 |

*Duplicate sample
Heat Temperature 1400° F.

TABLE 3

| | Crushing Strength, PSI | | |
|---|---|---|---|
| Treatment | Blank | 10% | 20% |
| #1 | 8076+ | 8076+ | 8076+ |
| #3 | 8076+ | 8076+ | 1982 |
| #4 | 8076+ | 8076+ | 1909/1322* |

*Duplicate sample
Heat Temperature 1200° F.

As can be seen from the above Tables, only treatment with Products A and B, i.e. Treatments #3 and #4, were successful in lowering the sinter strength of the sample buttons over the blanks which were not treated. The acid containing Treatments, #1 and #2, which represent some of the conventional means for controlling deposits, were ineffective in reducing sinter strength over the blank. Readings over 8076 (8076+ in the Tables) exceeded the capability of the equipment used in the experiment.

EXAMPLE II

Ash Fusion Test with Samples Subjected to Various Treatments

Deposit samples were collected as in Example I. Solid cones of deposit sample were progressively heated in a furnace in a reducing environment (red), an oxidizing environment (ox), or both as indicated in Tables 4 and 5. The temperatures in degrees Fahrenheit at which the cone lost its integrity, in four stages, are also recorded in Tables 4 and 5 below. Initial Deformation Temperature (IDT) indicates the temperature at which the apex of the cone became rounded, Softening Temperature (ST) when the cone was reduced to approximately half of its size, Hemispherical Temperature (HT) when the height of the cone equaled the base of the cone, and Fluid Temperature (FT) when the cone was in a molten state. Treatment numbers correspond with those in Example 1 and the percent by weight of fuel conditioner for each sample is recorded in Tables 4 and 5.

TABLE 4

| | Ash Fusion Temperatures, °F. | | | | | | | |
|---|---|---|---|---|---|---|---|---|
| Fusion | Blank | | Treatment #3, 5% | | Treatment #3, 10% | | Treatment #3, 20% | |
| Stages | Red | Ox | Red | Ox | Red | Ox | Red | Ox |
| IDT | 1876 | 2106 | 2065 | 2262 | — | 2223 | — | 2201 |
| ST | 1990 | 2220 | 2185 | 2317 | — | 2331 | — | 2290 |
| HT | 2100 | 2278 | 2250 | 2359 | — | 2430 | — | 2400 |
| FT | 2160 | 2410 | 2328 | 2436 | — | 2580 | — | 2475 |

TABLE 5

| | Ash Fusion Temperatures, °F. | | | | | | | |
|---|---|---|---|---|---|---|---|---|
| Fusion | Blank | | Treatment #4, 20% | | Treatment #2, 10% | | Treatment #2, 20% | |
| stages | Red | Ox | Red | Ox | Red | Ox | Red | Ox |
| IDT | 1876 | 2106 | 2065 | 2262 | — | 2065 | — | 2060 |
| ST | 1990 | 2220 | 2185 | 2317 | — | 2180 | — | 2185 |
| HT | 2100 | 2278 | 2250 | 2359 | — | 2254 | — | 2306 |
| FT | 2160 | 2410 | 2328 | 2436 | — | 2290 | — | 2447 |

Raising the ash fusion temperatures decreases the adhering tendencies of the deposits, which means the deposits are more easily removed by conventional soot-blowing means. As can be seen from Tables 4 and 5, treatment with the Products A and B, i.e. Treatments 3 and #4, raised the ash fusion temperature in all cases under both oxidizing and, when tested, reducing conditions. For example, the Initial Deformation Temperature (IDT) was raised by approximately 100° F. under oxidizing conditions and by about 190° F. under reducing conditions. The acid treatment, Treatment #2, was done under oxidizing conditions only. This treatment, which again represented conventional fuel conditioning means, actually resulted in lowering the IDT. Accordingly, it is illustrated that the novel methods of the present invention result in lowering the adhering tendencies of the deposit in all cases, while the conventional methods do not.

EXAMPLE III

Field Test Employing the Methods of the Present Invention

The methods of the present invention were tested on two field erected boilers. These boilers burned a combination fuel consisting of sludge, biomass, saw dust pellets, No. 6 fuel oil, and, when indicated in Tables 6 and 7, tire derived fuels. At all times referenced in this example, Boiler #1 produced approximately 450,000 pounds of steam per hour and boiler #2 approximately 600,000 pounds of steam per hour; both boilers operated at 850 psi with a super heated steam temperature of 850° F.

Two treatment programs were evaluated in this Example. The first was a conventional treatment, Treatment 1, which consisted of feeding a product having two components: (a) a solution of organo magnesium and barium compounds with magnesium carbonate in oil, and (b) a mixture of powder containing alumina, silica and titania. These products was obtained from Betz Corp., and are available under the tradenames DG850 and Fuelpro 3276, respectively. The oil based product, component (a), was fed to the fuel oil being burned at a rate of about 7 pounds of product per about every 1000 gallons of oil fired. Component (b) was injected directly into the fireside of the boiler by blowing it in at a rate of between about 4 and 6 pounds per hour. This treatment was evaluated only when tire derived fuels were not being burned.

The second treatment, Treatment 2, consisted of feeding Product A and Product D as obtained from Calgon Corporation. Product A is a suspension of magnesium hydroxide in water, and Product D is an oil based solution containing organo compounds of magnesium and barium together with magnesium carbonate. These products are described more completely above. Both products were fed into the fireside of the boiler with the No.6 fuel oil. Product A was fed at a rate of between approximately 30 and 90 gallons per day, as indicated in Tables 6 and 7; Product D was fed at a rate of about 6 gallons per every 1000 gallons of oil fired. This treatment was administered both when tire derived fuels were being burned and when they were not being burned.

The amount of fireside deposit was monitored on line by high temperature deposit probes, the operation of which will be familiar to those having ordinary skill in the art. The deposit probes were inserted into the fireside of the boilers in front of the superheater tubes. The probe temperature was maintained at around 925° F. by regulating the flow of compressed air through the tube.

After three hours of exposure in the furnace, the probes were removed, cooled to room temperature and carefully scraped over a two foot section to remove the deposits formed thereon. The deposits were then weighed. The total weight of the deposits was divided by 2, to get the amount of deposit per foot of the probe. These results are recorded in Tables 6 and 7 below.

TABLE 6

| | High Temperature Deposit on Boiler #1 | | |
|---|---|---|---|
| Treatment # | Tire Derived Fuels Burned (Yes/No) | Deposit Weight (grams/foot) | Comments |
| 1 | No | 14.95 | Extremely Hard deposit |
| 2* | No | 3.21 | Moderately Hard Deposit |
| 2* | No | 2.91 | Moderately Hard Deposit |
| 2* | Yes | 3.68 | Moderately Hard Deposit |
| 2* | Yes | 3.5 | Moderately Hard Deposit |
| 2** | Yes | 4.1 | Moderately Hard Deposit |
| 2*** | Yes | 5.79 | Moderately Hard Deposit |

* = Treatment with about 60 gallons per day Product A
** = Treatment with about 90 gallons per day Product A
*** = Treatment with about 30 gallons per day Product A

TABLE 7

| High Temperature Deposit on Boiler #2 | | | |
|---|---|---|---|
| Treatment # | Tire Derived Fuels Burned (Yes/No) | Deposit Weight (grams/foot) | Comments |
| 1 | No | 2.35 | Very hard deposit |
| 2* | No | 0.74 | hard deposit |
| 2* | No | 0.54 | hard deposit |
| 2* | No | 0.85 | hard deposit |

* = Treatment with about 60 gallons per day Product A

As can be seen from the results presented in Tables 6 and 7, treatment with the methods of the present invention (treatment 2) was far superior than treatment with conventional methods (treatment 1) when tire derived fuels were not being burned; the amount of deposit is significantly lower with treatment 2 than with treatment 1. As is described above, and as will be appreciated by those skilled in the art, burning tire derived fuels results in higher deposits than those which occur in systems not firing tire derived fuels. Treatment 2 was able to maintain the same low levels of deposits even when tire derived fuels were being burned. Treatment 1 was not administered when tire derived fuels were being burned. It can be projected, however, that if treatment 1 had been applied when burning tire derived fuels, the deposit weight would have been at least as high as it was when tire derived fuels were not being burned—14.95 and 2.35 grams/foot for boilers 1 and 2 respectively. Because burning tire derived fuels results in much higher fireside deposits, it is likely that these values would have been even higher.

Not only was the amount of deposit lower when using treatment 2 than when using treatment 1, the nature of the deposit was different as well. In both boilers, the treatment 1 deposit was harder than the treatment 2 deposit. The harder the deposit, the harder it is to remove the deposit by normal soot blowing techniques. Further, the results in Table 6 illustrate that administering Product A at a rate of 60 gallons per day is the optimum dosage for that component when employing the methods of the present invention in a boiler producing about 450,000 pounds of steam per hour.

What is claimed is:

1. A method of minimizing deposit formation in a system firing tire derived fuels, comprising adding to said system an effective amount of a suspension comprising: (a) from about 45 to 50% by weight magnesium hydroxide ($Mg(OH)_2$) (b) from about 1 to 5% by weight organic dispersant selected from the group consisting of organic dispersants containing amino, sulfonyl and carboxylic groups; and (c) the balance water.

2. The method of minimizing deposit formation according to claim 1, wherein said effective amount is from about 30 to 100 gallons per day of said suspension, and wherein said system produces between about 200,000 and 600,000 pounds of steam per hour.

3. A method of minimizing deposit formation in a system firing tire derived fuels and fuel oil, comprising adding to the system an effective amount of a solution comprising: (a) an organic magnesium-manganese compound; (b) an organic dispersant selected from the group consisting of organic dispersants containing amino, sulfonyl and carboxylic groups; and (c) a solvent, wherein the active magnesium metal concentration of the solution is from about 4.5 to 5.5% by weight, and the active manganese metal concentration of the solution is from about 1 to 1.5% by weight.

4. A method according to claim 3 wherein about 1 gallon of the solution is added for about 500 to 5000 gallons of fuel oil.

5. A method according to claim 3 wherein the solvent is water.

6. A method according to claim 3 wherein the solvent is No. 2 fuel oil.

7. A method according to claim 3 in which the solution is added in an amount such that any deposit which forms in the system contains from about 1 to 10% by weight magnesium oxide.

8. The method of minimizing deposit formation according to claim 3 which method further comprises adding to said system an effective amount of a suspension comprising: (a) from about 45 to 50% by weight magnesium hydroxide ($Mg(OH)_2$); (b) from about 1 to 5% by weight organic dispersant selected from the group consisting of organic dispersants containing amino, sulfonyl and carboxylic groups; and (c) the balance water.

9. A method of minimizing deposit formation in a system firing tire derived fuels and fuel oil, comprising adding to the system an effective amount of a solution of (a) an organo-magnesium compound and (b) an organo-barium compound, wherein the active magnesium metal concentration of the solution is about 4.5 to 5.5% by weight, and the active barium metal concentration of the solution is about 0.3 to 0.5% by weight.

10. A method according to claim 9 in which the solution is added in an amount such that any deposit which forms in the system contains from about 1 to 10% by weight magnesium oxide.

11. The method according to claim 9 further comprising adding to said system an effective amount of a suspension comprising: (a) from about 45 to 50% by weight magnesium hydroxide ($Mg(OH)_2$); (b) from about 1 to 5% by weight organic dispersant selected from the group consisting of organic dispersants containing amino, sulfonyl and carboxylic groups; and (c) the balance water.

* * * * *